US010339905B2

(12) United States Patent
Washington

(10) Patent No.: US 10,339,905 B2
(45) Date of Patent: Jul. 2, 2019

(54) ILLUMINATED INSTRUMENT STRAP

(71) Applicant: Derek Washington, Auburn Hills, MI (US)

(72) Inventor: Derek Washington, Auburn Hills, MI (US)

( * ) Notice: Subject to any disclaimer, the term of this patent is extended or adjusted under 35 U.S.C. 154(b) by 0 days.

(21) Appl. No.: 15/997,671

(22) Filed: Jun. 4, 2018

(65) Prior Publication Data

US 2018/0286365 A1 Oct. 4, 2018

Related U.S. Application Data

(63) Continuation-in-part of application No. 15/460,706, filed on Mar. 16, 2017, now Pat. No. 10,013,962.

(60) Provisional application No. 62/308,913, filed on Mar. 16, 2016.

(51) Int. Cl.

| | |
|---|---|
| ***G10G 5/00*** | (2006.01) |
| ***F21V 33/00*** | (2006.01) |
| ***F21V 23/00*** | (2015.01) |
| ***F21V 23/04*** | (2006.01) |

(Continued)

(52) U.S. Cl.

CPC ..... *G10G 5/005* (2013.01); *F21V 23/009* (2013.01); *F21V 23/0492* (2013.01); *F21V 33/0056* (2013.01); *F21W 2121/06* (2013.01); *F21Y 2115/10* (2016.08)

(58) Field of Classification Search

CPC ..... G10G 5/005

See application file for complete search history.

(56) References Cited

U.S. PATENT DOCUMENTS 4,236,191 A * 11/1980 Martinez ..... G02B 6/0005 362/554

4,523,258 A * 6/1985 Morse ..... F21V 33/0008 362/108

4,563,933 A 1/1986 Kim (Continued)

OTHER PUBLICATIONS

Meadows: Ukulele Strap https://www.youtube.com/watch?v=rw4RHPcBWxE, See parent application.

(Continued)

*Primary Examiner* — Robert W Horn

(74) *Attorney, Agent, or Firm* — Singh Law Form, PLLC; Gautam B. Singh

(57) ABSTRACT

The Illuminated Instrument Strap includes fasteners to removably secure it to an instrument. A light, including a plurality of LEDs capable of generating colors, are operably connected to a control box is disposed along the length of the instrument strap. The control box which could be embedded within the belt includes or attached to it includes a battery which is rechargeable, control switches, a controller that includes a logic that is at least partially stored in a non-transitory computer readable medium. When executed at least in part by the controller the logic causes the light to illuminate in a pre-programmed pattern generated from the logic. Alternatively, the controller is adapted to generate a pattern from an audio input information obtained from a microphone, or from a signal received from a musical instrument, such that illumination of the light is synchronized to the audio input or the musical instrument signal thereby creating a music visualization pattern.

18 Claims, 7 Drawing Sheets

(51) Int. Cl.
*F21W 121/06* (2006.01)
*F21Y 115/10* (2016.01)

(56) References Cited

U.S. PATENT DOCUMENTS 4,887,552 A * 12/1989 Hayden ..... A01K 27/006 119/793
6,283,612 B1 * 9/2001 Hunter ..... F21V 15/015 362/217.05
6,371,637 B1 * 4/2002 Atchinson ..... F21V 19/005 362/249.04
6,557,498 B1 * 5/2003 Smierciak ..... A01K 27/006 119/858
6,846,094 B2 * 1/2005 Luk ..... H05B 33/0857 362/240
7,594,482 B1 * 9/2009 Toplin ..... A01K 27/006 119/792
8,840,263 B1 * 9/2014 Jones ..... A41D 13/01 362/108
9,545,084 B2 * 1/2017 Osher ..... A01K 27/006
10,013,962 B2 * 7/2018 Washington ..... H05B 33/0842
2007/0263385 A1 * 11/2007 Fan ..... G09F 13/22 362/249.16
2011/0102304 A1 5/2011 Nelson
2013/0235570 A1 * 9/2013 Hood ..... F21V 21/00 362/225
2014/0098523 A1 * 4/2014 Sutton ..... A41D 13/00 362/103
2015/0345717 A1 * 12/2015 Gerpheide ..... F21L 4/02 362/158
2016/0223149 A1 * 8/2016 Gerpheide ..... F21L 4/00
2018/0286365 A1 * 10/2018 Washington ..... G10G 5/005

OTHER PUBLICATIONS

Lam: Triple LED Guitar Strap https://www.youtube.com/watch?v=WU46VfW_xko, See parent application.

* cited by examiner

ILLUMINATED INSTRUMENT STRAP

CROSS REFERENCE TO RELATED APPLICATIONS

This is a Continuation-In-Part of Ser. No. 15,460,706, filed Mar. 16, 2017, which claims the benefit of U.S. Provisional Application No. 62/308,913 filed on Mar. 16, 2016. The above identified patent applications are herein incorporated by reference in its entirety to provide a continuity of disclosure.

FIELD OF THE INVENTION

The present invention relates to instrument straps. More specifically, the present invention provides an illuminated instrument strap.

BACKGROUND OF THE INVENTION

Instrument straps are frequently used to assist in supporting the instrument while the musician plays it. Many musicians enjoy employing theatricality by customizing their equipment and instruments to provide a unique appearance. Generally, instrument straps are not modified or customized by musicians as they are not easily visible to the audience. Therefore, an instrument strap that provides a more visible and unique appearance than conventional straps via a series of lights is provided.

In light of the devices disclosed in the known art, it is submitted that the present invention substantially diverges in design elements from the known art and consequently it is clear that there is a need in the art for an improvement to existing instrument straps. In this regard, the instant invention substantially fulfills these needs.

SUMMARY OF THE INVENTION

In view of the foregoing disadvantages inherent in the known types of instrument straps now present in the prior art, the present invention provides an illuminated instrument strap wherein the same can be utilized for providing convenience for the user when customizing the user's equipment to create a visible and unique appearance.

The present system comprises an instrument strap. A fastener adapted to removably secure the instrument strap to an instrument is disposed on the instrument strap. A plurality of lights is disposed along the length of the instrument strap. A control box having a power source and a power button is operably connected to the plurality of lights. In some embodiments, the control box further comprises a controller adapted to illuminate the plurality of lights in a pre-programmed pattern stored at least partially in the non-transitory memory of the controller.

In an embodiment, the control box further comprises a microphone adapted to transmit an audio input to the controller to synchronize the illumination of the plurality of lights to the audio input in a music visualization pattern. An embodiment also includes an input signal directly fed from the music instrument being played. The instrument strap includes a cutout with a receptor connector where the input signal feed from an instrument or device is inserted. In an embodiment, the control box further comprises a switch adapted to toggle between the pre-programmed pattern, the sound input from the microphone, or the direct signal feed from an instrument or device.

An embodiment of the invention includes a rechargeable battery, and the control box includes a USB or another standard connector for consumer electronics. An embodiment also provides for the inclusion of a remote receiver in the control box so that the pre-programmed patterns to be displayed are remotely selected and the control box can be remotely switched on or off. Further, an embodiment includes an inbuilt shut-off timer to turn the control box off when not in use for a predetermined duration.

In an embodiment, the control box comprises a potentiometer adapted to vary the frequency of the pre-programmed pattern. An embodiment also includes an input signal level adjuster whereby signal strength is reduced when the audio or electrical signals become too strong and cause the controller pattern to saturate, or to alternatively amplify the audio signal or electrical signal in case they are too weak. In an embodiment, the control box is removably secured to the instrument strap. And further in an embodiment, the control box is embedded in the belt with a cutout and the controls made available outside to make toggle signal, recharge battery, adjust input signal levels, or to turn the control box on or off.

In an embodiment, the plurality of lights comprises a plurality of LEDs. in an embodiment the instrument strap further comprises an adjustment mechanism configured to change the length of the instrument strap. In an embodiment, the plurality of lights is arranged in one or more rows along the length of the instrument strap. In another embodiment, the fastener comprises an aperture.

BRIEF DESCRIPTION OF THE DRAWINGS

For a more complete understanding of the invention, reference is made to the following description and accompanying drawings, in which.

DETAILED DESCRIPTION

Figures 1A, 1B, 1C, 1D:
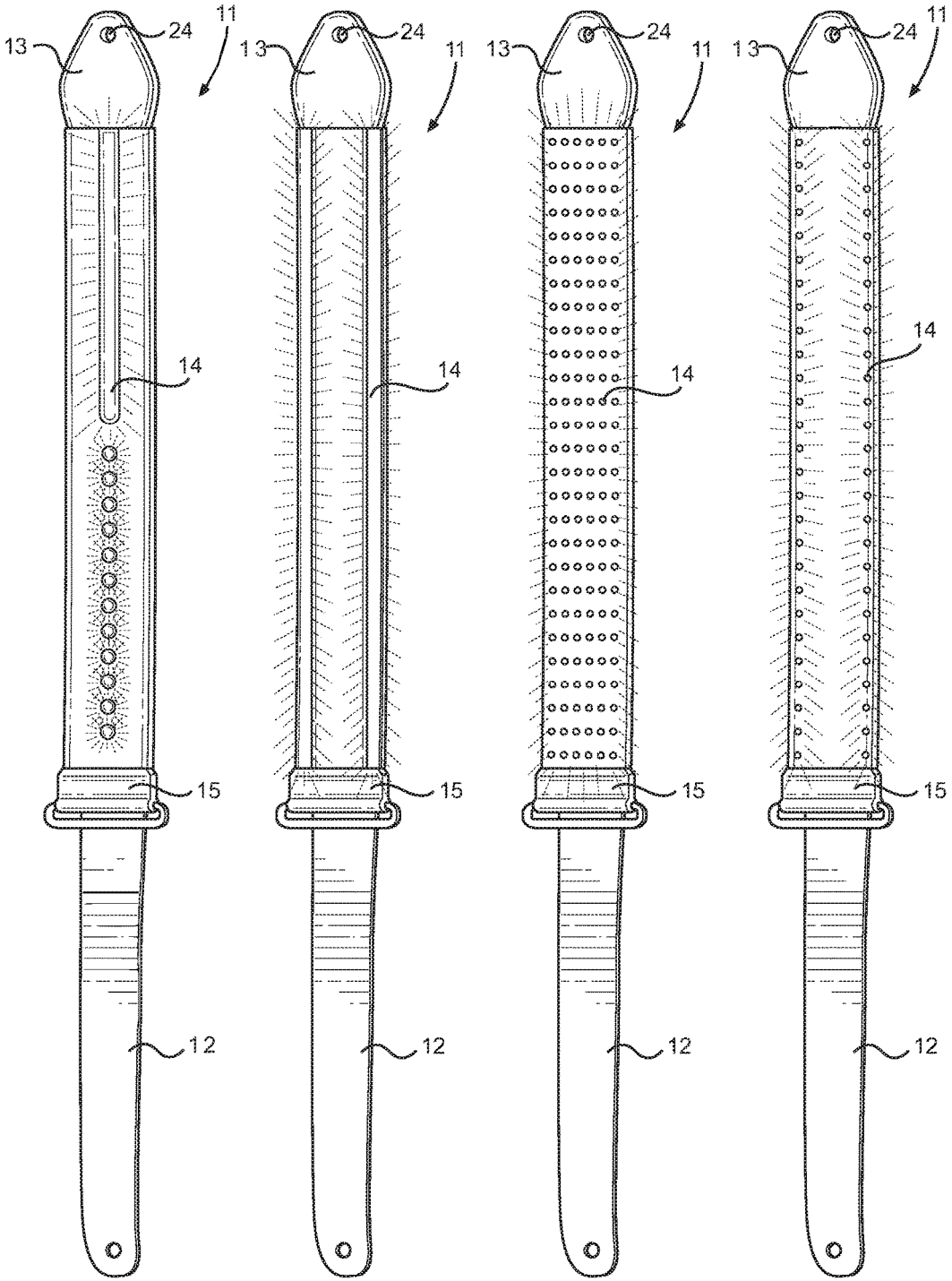
FIG. 1A shows the front view of an embodiment of the illuminated instrument strap.
FIG. 1B shows a front view of an alternate embodiment of the illuminated instrument strap.
FIG. 1C shows a front view of an alternate embodiment of the illuminated instrument strap.
FIG. 1D shows a front view of an alternate embodiment of the illuminated instrument strap.

Reference is made herein to the attached drawings. Like reference numerals are used throughout the drawings to depict like or similar elements of the instrument strap. The figures are intended for representative purposes only and should not be considered to be limiting in any respect.

FIG. 1A shows the front view of an embodiment of the illuminated instrument strap; FIG. 1B shows a front view of an alternate embodiment of the illuminated instrument strap; FIG. 1C shows a front view of an alternate embodiment of the illuminated instrument strap; FIG. 1D shows a front view of an alternate embodiment of the illuminated instrument strap.

Referring now to FIGS. 1A, 1B, 1C, and 1D, there is shown a front view of several embodiments of the illuminated instrument strap. The embodiment shows an Illuminated Instrument Strap 11 having a first end 12 and a second end 13. In some embodiments, the Illuminated Instrument Strap 11 comprises a fabric material. In the illustrated embodiment, the first end 12 and the second end 13 further comprise fasteners 24 adapted to removably secure to an instrument including, but not limited to, a guitar and a bass guitar. In the illustrated embodiments, the fasteners 24 comprise an aperture thereon to engage with the attachment protrusions of a guitar. In other embodiments, the fasteners 24 include other fastening means, such as D-rings, hooks, and carabiners. In some embodiments, the Illuminated Instrument Strap 11 comprises an adjustment mechanism 15, such as a buckle or loop, that allows the Illuminated Instrument Strap 11 to be varied to a desired length.

In the illustrated embodiment, a plurality of lights 14 disposed along the length of the Illuminated Instrument Strap 11. In the illustrated embodiments, the plurality of lights 14 comprises LEDs, however other lighting options are acceptable. The plurality of lights 14 may be arranged in one or more rows along the length of the Illuminated Instrument Strap 11. For example, in the illustrated embodiments, the plurality of lights 14 may comprise a single row down the center of the Illuminated Instrument Strap 11, two rows down the edges of the Illuminated Instrument Strap 11, several rows down the entirety of the center of the Illuminated Instrument Strap 11, and other similar arrangements. In some embodiments, the plurality of lights 14 comprise a light strip. The plurality of lights 14 may also comprise a variety of colored LEDs.

Figure 2:
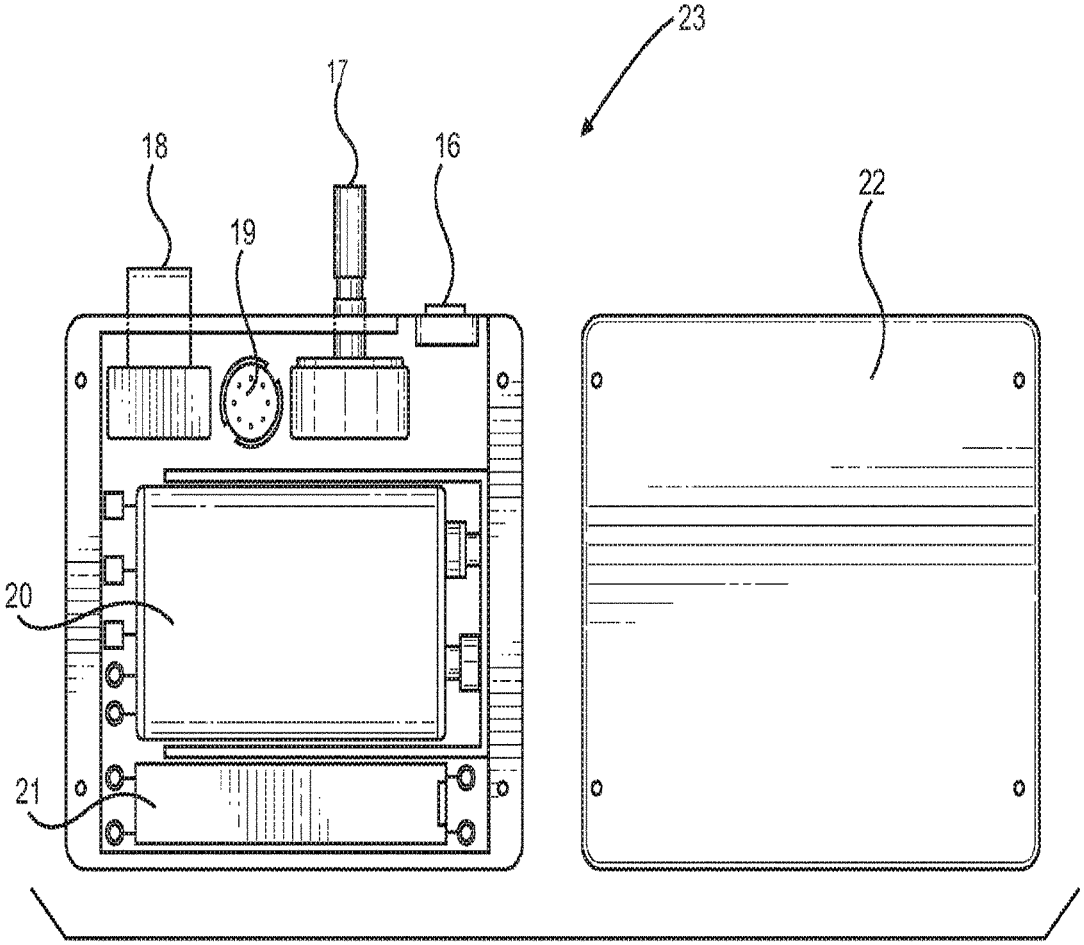
FIG. 2 shows a top down view of an embodiment of the control box of the illuminated instrument strap.

Referring now to FIG. 2 which shows a top down view of an embodiment of the control box of the illuminated instrument strap. The Illuminated Instrument Strap 11 further comprises a control box 23 is electrically connected to the plurality of lights 14. In the illustrated embodiment, the control box 23 comprises a power source 20, a power button 16, and a lid 22. The power source 20 provides power to the plurality of lights 14, illuminating them, when the power button 16 is actuated. The lid 22 removably secures to the top of the control box 23 protecting the internal components from damage during use.

In the illustrated embodiment, the control box 23 further comprises a controller 21. The controller 21 at least in part executes a logic that illuminates the plurality of lights 14 in one of several pre-programmed patterns at least partially stored in the non-transitory memory of the controller 21. The pre-programmed patterns may include steady flashing, randomized flashing, sequential illumination, and the like. In the illustrated embodiment, the control box 23 further comprises a sensor 17. In some embodiments, the sensor 17 comprises a potentiometer. The sensor 17 controls the speed of the pre-programmed patterns. For example, if the selected pre-programmed pattern was steadily flashing, when turned in one direction, the sensor 17 would slow the frequency of flashing, and in the opposite direction, the frequency of flashing would increase, up to constant illumination.

In the illustrated embodiment, the control box 23 further comprises a music visualization system. A microphone 19 transmits a received audio input signal to the controller 21. The controller 21 activates the plurality of lights 14 such that the plurality of lights 14 are illuminated in synchronization with the audio input signals received by the microphone 19. In this way, the plurality of lights 14 are illuminated in time with the music being played on the instrument. In the illustrated embodiment, the control box 23 includes a toggle-switch 18. The toggle-switch 18 is adapted to toggle between the pre-programmed patterns of the controller 21 and the music visualization pattern created by the audio input signals from the microphone 19.

Figure 3:
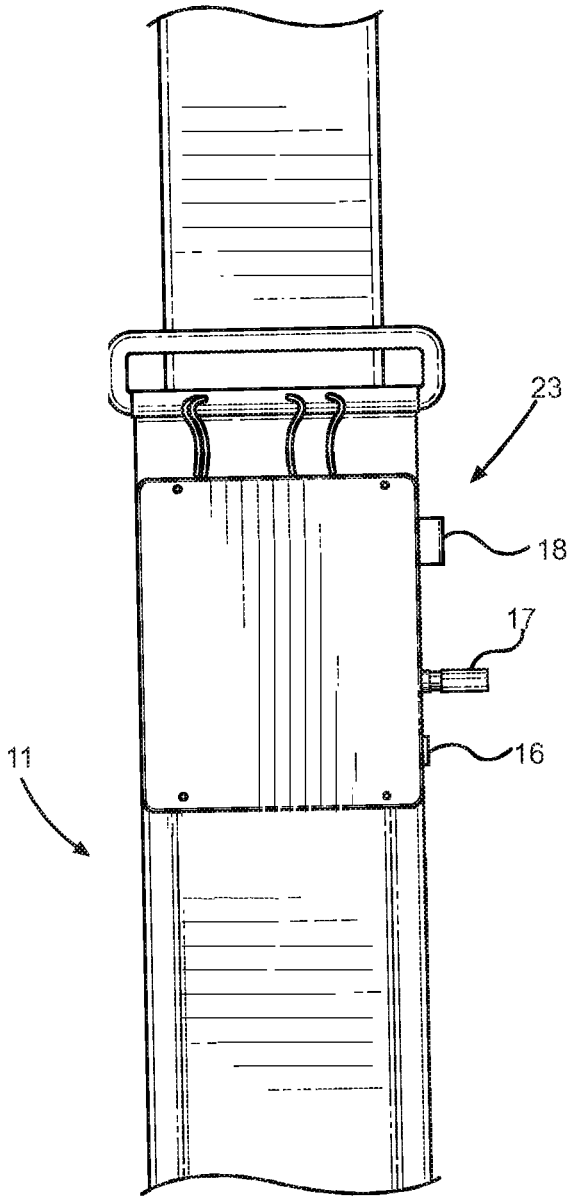
FIG. 3 shows a rear view of an embodiment of the illuminated instrument strap.

Referring now to to FIG. 3 which shows a rear view of an embodiment of the illuminated instrument strap. In the illustrated embodiment, the control box 23 is removably secured at the rear of the Illuminated Instrument Strap 11, at one of the first end 12 or the second end 13. This positioning allows the user to interact with the control box 23 while wearing the Illuminated Instrument Strap 11. The control box 23 is operably connected to the plurality of lights 14 disposed on the front of the instrument strap. In some embodiments, the control box 23 is connected to the plurality of lights 14 wirelessly. In some embodiments, the control box 23 is removably secured to the Illuminated Instrument Strap 11, while in other embodiments, the control box 23 is contained within a pocket disposed on the rear of the Illuminated Instrument Strap 11.

In one use, the user would removably secure the Illuminated Instrument Strap 11 to the instrument to be played at the first end 12 and the second end 13. The user would determine which of the pre-programmed patterns they would like the plurality of lights 14 to display. In the illustrated embodiment, the user would then adjust the sensor 17 to increase or decrease the frequency the plurality of lights 14 would display the chosen pattern. The user may also decide to instead synchronize the flashing of the plurality of lights 14 with the music being played. The user would then toggle the toggle-switch 18 to activate the microphone 19. The microphone 19 would then transmit the incoming audio input signals to the controller 21, which in turn activates the plurality of lights 14 in time with audio input signals, in a music visualization pattern. The user would then put on the instrument by draping the Illuminated Instrument Strap 11 over their shoulder. At any time during the performance, the user may decide to alter the frequency of the pattern by adjusting the sensor 17, or toggle the toggle-switch 18 to change the activation of the plurality of lights 14 to the alternate option. The position of the control box 23 at either the first end 12 or the second end 13 on the Illuminated Instrument Strap 11 allows the user to interact with the control box 23 while playing the instrument.

An illuminated instrument strap is disclosed comprising a first end and a second end wherein each of the first end and the second end has a fastener disposed thereupon with each of the fastener adapted to removably secure the instrument strap to an instrument; an adjustment mechanism where the adjustment mechanism is disposed between the first end and the second end and separates the instrument strap into a first segment and a second segment wherein the adjustment mechanism is further adapted to change the length of the instrument strap by shortening or elongating a length of the second segment; a light disposed on first segment of the instrument strap, the light having a connection to a control box wherein the connection between the control box and light is adapted to supply a power to the light; a power source capable of supplying the power to the light; the control box attached to the first segment comprising a controller having a non-transitory memory which at least partially stores a logic where the non-transitory memory is in a medium readable by the controller, a plurality of input signals readable by the controller, a plurality of illumination codes readable by the controller adapted to select a previously stored illumination pattern program from non-transitory memory, such that upon reading and executing the logic at least in part by the controller causes the control box to enable the power source to supply power to the light to cause the lights to illuminate in a manner determined by the logic, the plurality of input signals, and the illumination pattern program.

In an embodiment of the Illuminated Instrument Strap 11 the control box includes a remote receiver adapted to receive the plurality of illumination codes from a remote control. In an embodiment of the Illuminated Instrument Strap 11 the control box further includes a power source. In an embodiment of the illuminated instrument the control box the power source is a battery. In an embodiment of the illuminated instrument the control box where the power source is a battery, where the battery is further capable of being recharged with the control box including a connector adapted to receive a power source, and connecting the power source to the connector recharges the battery.

Figure 4:
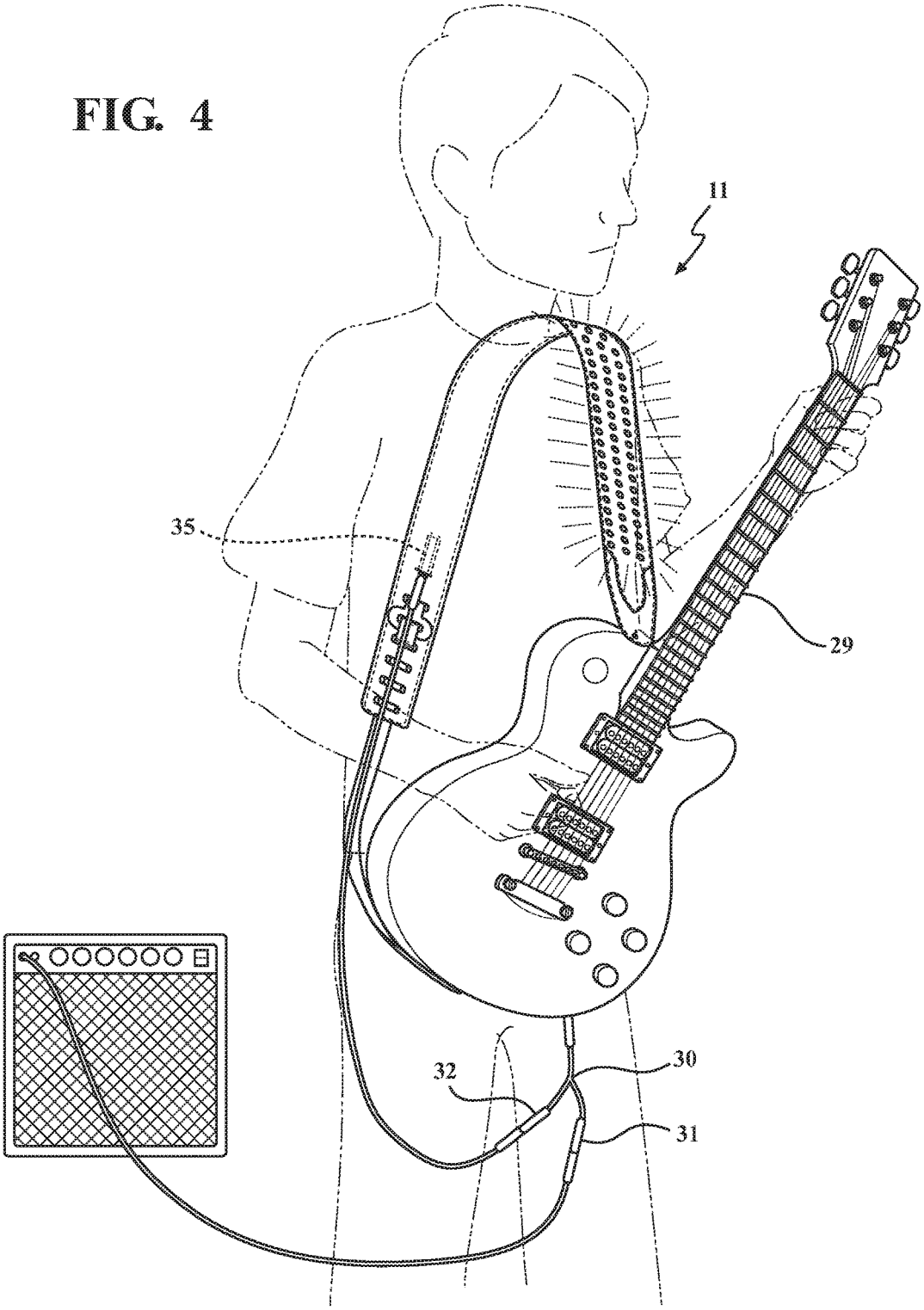
FIG. 4 shows a player using an electrical musical instrument and utilizing a splitter to feed electrical signal from an electrical musical instrument, not limited to an electrical guitar (shown), keyboard, or piano to the speaker and to the Illuminated Instrument Strap.

Referring now to FIG. 4 which shows a player using an electrical musical instrument and utilizing a splitter to feed electrical signal from an electrical musical instrument, not limited to an electrical guitar (shown), keyboard, or piano to the speaker and to the Illuminated Instrument Strap. In the illustrated embodiment, a signal splitter 30, which takes an electrical signal as input signal and splits it into two or more output signals of identical characteristics as the input signal, is utilized. A signal splitter 30 is utilized to split the signal coming from the electrical musical instrument 29 into a signal speaker-input 31 designed to feed an audio amplifier or a speaker, and belt-input 32 that is adapted to feed signal back to the Illuminated Instrument Strap 11. The belt-input 32 is fed to signal input connector 35 that is a connector adapted to receive an electrical signal controlling the lights on the Illuminated Instrument Strap 11. In the manner the signal received from the signal input connector 35 is produced by electrical musical instrument 29 thereby making the illumination patterns correspond to the electrical signals being played on the electrical musical instrument 29. The lighting patterns displayed on Illuminated Instrument Strap 11 are thus harmonized and produced in response to specific notes being played on the electrical musical instrument 29.

In an embodiment of the Illuminated Instrument Strap 11, the plurality of input signals comprise audio signal from a microphone, where the microphone is adapted to sense audio energy in the environment and generate a corresponding audio signal; and electronic signal generated by an electrical or an electronic device; where the controller is programmed to use either the audio signal, or the electronic signal, or a combination of both the audio signal and the electronic signal, to create the logic where the logic causes the illumination pattern of the light to be synchronized with the audio signal, the electronic signal, or a combination of both signals, whereby the light illumination patterns represents a visualization of the audio signal, the electronic signal, or a combination of both signals. In an embodiment of the Illuminated Instrument Strap 11, the electronic signal is generated by an electronic musical instrument selected from a group consisting of guitar, piano, keyboard, wind-instrument and percussion-instrument.

An embodiment of the Illuminated Instrument Strap 11 includes a three-way toggle switch 46 adapted to a selection of one of the illumination pattern programs, audio signal, or electronic signal, to read and execute the logic for generating the illumination patterns where the controller is programmed to use the selection of illumination pattern program, the audio signal, or the electronic signal, to create the logic causing the illumination pattern of the light to be synchronized with the selected illumination pattern program, the audio signal, or the electronic signal.

In an embodiment of the invention, the first segment having a length and a width dimension further comprising a two-ply composite with an upper-ply 27 having a length and a width dimension and a top and a bottom surface where the upper-ply 27's length and the width dimension are approximately equal to the first segment's length and width dimension respectively, a lower-ply 25 having a length and a width dimension and a top and a bottom surface where the lower-ply 25's length and the width dimension are approximately equal to the first segment's length and width dimension respectively, the bottom surface of the upper-ply 27 is attached to the top surface of the lower-ply 25 at predetermined locations to form the two-ply composite such that the two-ply composite's length and width dimension are approximately equal to the first segment's length and width dimension respectively, wherein the two-ply composite includes a space between bottom surface of the upper-ply 27 and the top surface of the lower-ply 25; and the light is included in the space between the upper-ply 27 and lower-ply 25; the upper-ply 27 includes a hole where the hole is an opening adapted to make one or more of the plurality of lights become visible there-through.

Figure 5:
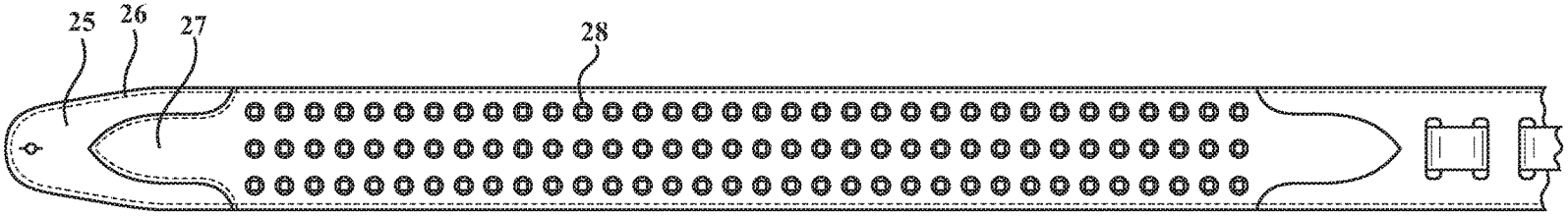
FIG. 5 shows an embodiment of the Illuminated Instrument Strap showing a construction with lights embedded between two layers of a two-ply belt.
Figure 6:
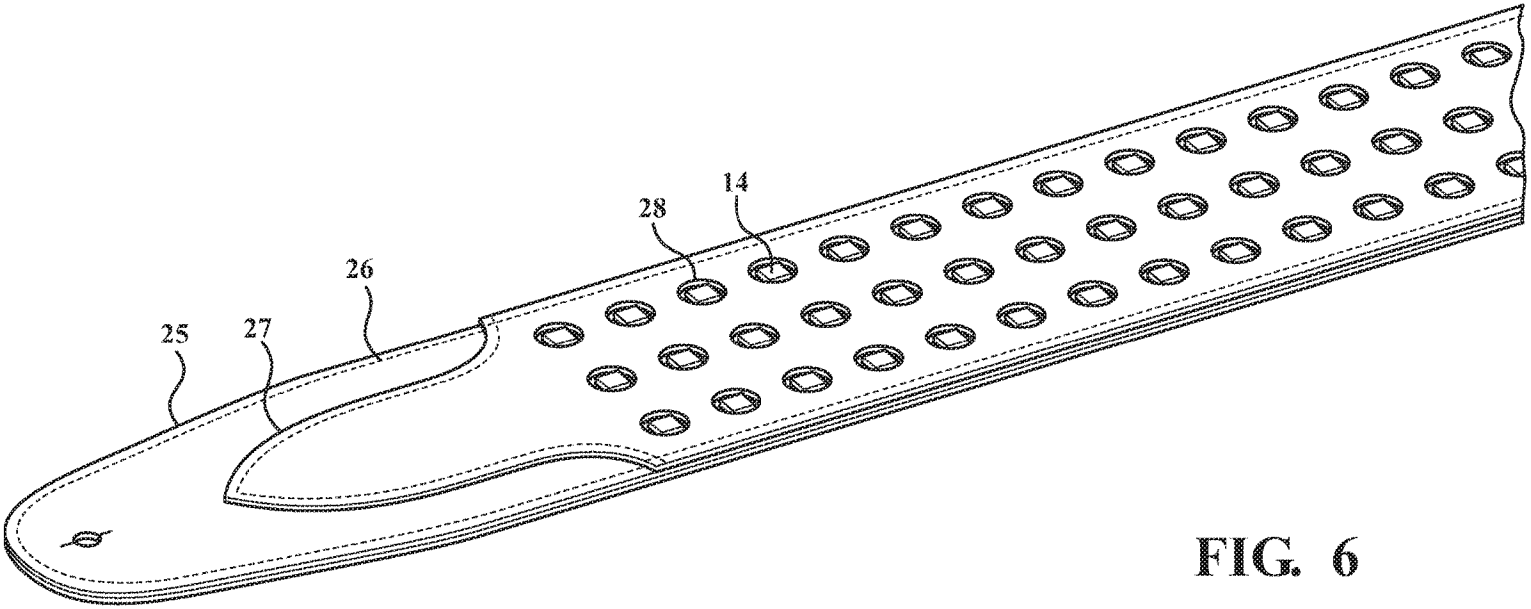
FIG. 6 shows an enlarged view of section of the embodiment shown in FIG. 5.

Referring now to FIG. 5 which shows an embodiment of the Illuminated Instrument Strap showing a construction with lights embedded between two layers of a two-ply belt, and to FIG. 6 which shows an enlarged view of section of the embodiment shown in FIG. 5. The embodiment of the invention shows a lower-ply 25, the lower-ply of a two-ply belt, is attached to an upper-ply 27, the upper-ply of a two-ply belt, with the two-plys of the belt being attached to each other with stitching 26 which fixedly attaching the lower-ply 25 to the upper-ply 27. The lights 14 and other electrical conductors are embedded between the lower-ply 25 and the upper-ply 27. Furthermore, the upper-ply 27 includes a plurality of holes 28, an opening in the upper-ply 27 allowing the light from the lights 14 to come through, placed at predetermined locations to enable light to come through from the plurality of lights 14 embedded between the lower-ply 25 and the upper-ply 27.

In the embodiment of the Illuminated Instrument Strap 11, the light comprise a plurality of Light Emitting Diodes (LEDs) wherein each LED is adapted to generate a set of three primary colors in response to a set of three signals received from the control box. In the embodiment Illuminated Instrument Strap 11, wherein the light included in the space between upper-ply 27 and lower-ply 25 comprises a plurality of lights arranged in a pattern, the upper-ply 27 includes a corresponding pattern of holes, where the corresponding pattern of holes is adapted to substantially enable the plurality of lights to be visible there-through.

In an embodiment of the invention the lower-ply 25 and the upper-ply 27 are removably attached such as the lower-ply 25 and the upper-ply 27 are attached to each other using detachable fasteners such as without limitation, Velcro, snap-buttons, or a zipper. The ability to separate the lower-ply 25 and the upper-ply 27 facilitates replacement of lights 14 or maintenance of other components embedded between the lower-ply 25 and the upper-ply 27 is easy to perform.

Figure 7:
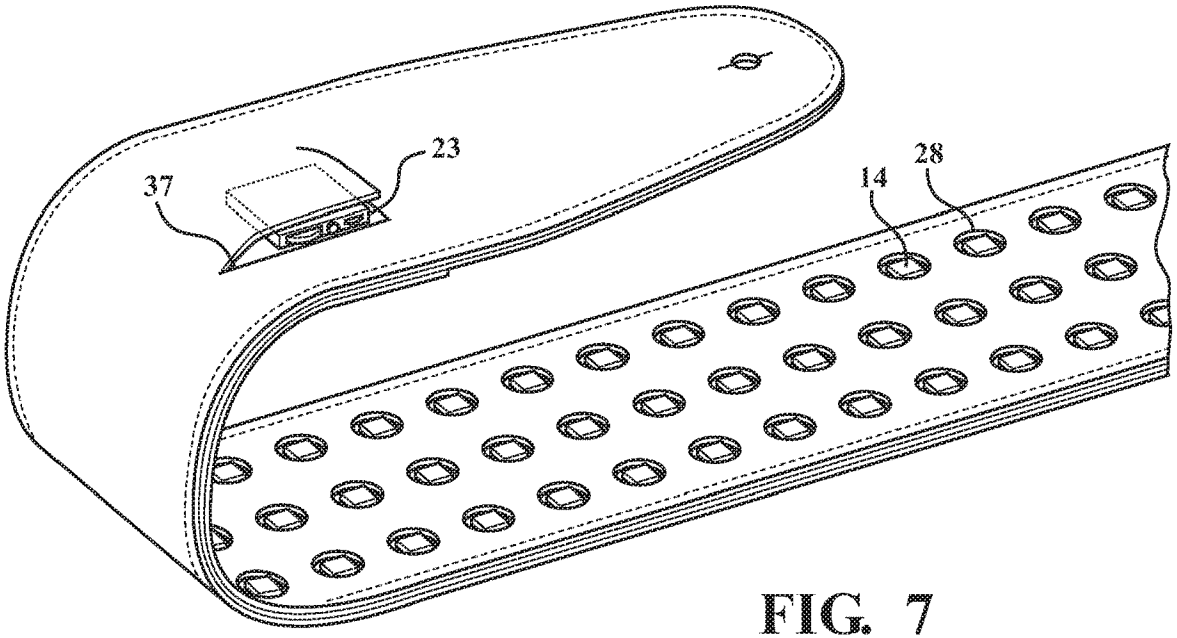
FIG. 7 shows an embodiment of the invention where the control box has been reduced in size and embedded between the lower-ply and the upper-ply and a controller cut-out in the lower-ply makes the various control on the control box accessible.

Referring now to FIG. 7 which shows an embodiment of the invention where the control box has been reduced in size and embedded between the lower-ply and the upper-ply and a controller cut-out in the lower-ply makes the various control on the control box accessible. Illustrated here is the controller cut-out 37, a cut-out in the lower-ply 25 making for making the switches and other controls on the control box 23 accessible. In an embodiment of the invention the control box 23 is enclosed within the space between the lower-ply 25 and the upper-ply 27. In an embodiment of the invention, the electrical conductors connecting input to control box and control box to lights are enclosed within the space between the lower-ply 25 and the upper-ply 27.

In an embodiment of the invention the controller cut-out 37 is included on the upper-ply 27 of a two-ply Illuminated Instrument Strap 11. In an embodiment of the invention, the controller cut-out 37 is made by removing the stitching 26 or other removable attachments between the lower-ply 25 and the upper-ply 27 such that various switches and volume controls used in control box 23 are exposed along the thickness of the Illuminated Instrument Strap 11.

Figure 8:
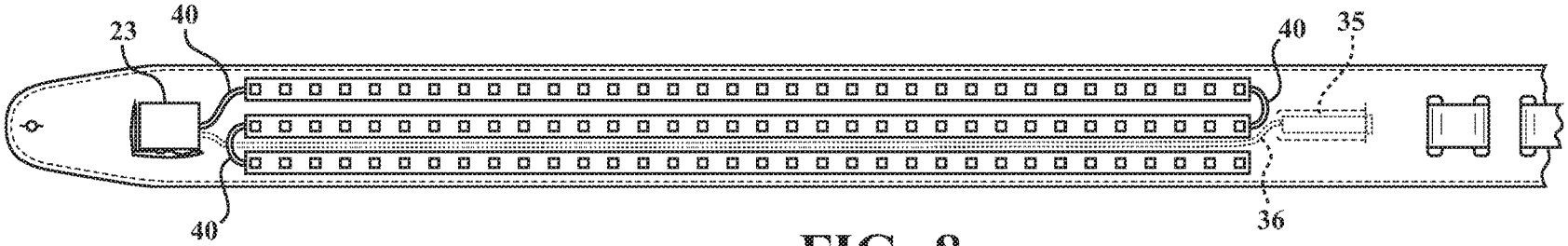
FIG. 8 shows a view of an embodiment of the invention where the upper-ply has been removed and the LED-strips, and the electrical circuitry embedded within the lower-ply and the upper-ply are shown.

Referring now to FIG. 8 which shows a view of an embodiment of the invention where the upper-ply has been removed and the LED-strips, and the electrical circuitry embedded within the lower-ply and the upper-ply are shown. In this illustration the signal received from the electrical musical instrument 29 is communicated to the signal input connector 35. This signal is communicated to the control box 23 over input conductor 36 which is an electrical conductor adapted to carry an input signal from signal input connector 35 to control box 23. The controller 21 in the control box 23 processes this input signal and based on the program stored in its memory generates a corresponding illumination signal for LED-strips 39, a strip of Light Emitting Diodes (LED) connected in series where each LED can produce light of a plurality of frequencies (colors) and intensities based on the input voltage applied. This illumination signal is communicated to the LED-strips 39 from the control box 23 over the LED signal conductor 40, an electrical conductor adapted to carry the lighting illumination signal from the control box 23 to the LED-strips 39.

Figure 9:
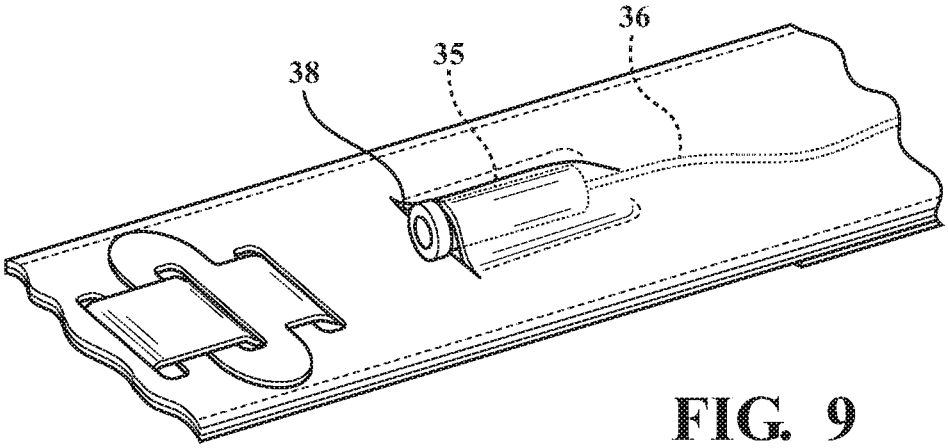
FIG. 9 illustrates an input cut-out for enclosing the signal input connector to keep it steady and confined to facilitate the process of attaching the belt-input from the signal splitter to the Illuminated Instrument Strap.

Referring now to FIG. 9 which illustrates an input cut-out for enclosing the signal input connector to keep it steady and confined to facilitate the process of attaching the belt-input from the signal splitter to the Illuminated Instrument Strap. Illustrated here is the input cut-out 38, a cut-out in the upper-ply 27 for making signal input connector 35 accessible.

In an embodiment of the invention, the input signal receiver is enclosed within the space between the lower-ply 25 and the upper-ply 27 wherein either lower-ply 25 or the upper-ply 27 includes a cut-out for attaching an external input source to the input signal receiver.

Figure 10:
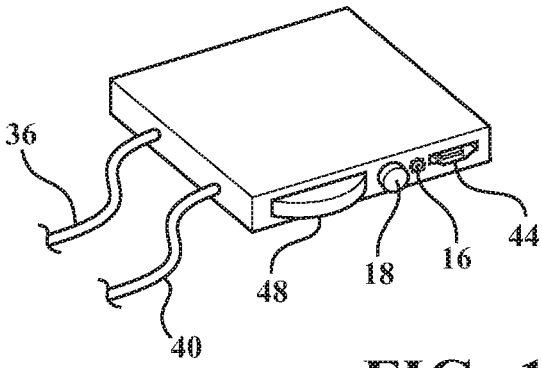
FIG. 10 shows the various switches and signal level control on the control box as well as a battery charger connector.

Referring now to FIG. 10 which shows the various switches and signal level control on the control box as well as a battery charger connector. In an embodiment of the invention a recharageble battery is used to supply power to the internal hardware and the lights 14 or the LED-strips 39. Illustrated in this embodiment are the various controls and switches as well as the charger connector 44 meant for a connector for charging a rechargeable battery used in the control box 23 to light the LED-strips 39 or a plurality of lights 14. An power button 16 is used for powering up the controller. The three-way toggle switch 46 selects illumination from pre-programmed patterns stored in memory, audio signals, or electrical signals. In an embodiment of the invention, the control box includes a plurality of physical control buttons and the lower-ply 25 includes a controller cut-out 37 adapted to have the physical controls protrude below the lower surface of the lower-ply 25.

In an embodiment of the Illuminated Instrument Strap 11, the control box further includes a control for level adjustment adapted to attenuate or amplify one or more of the plurality of input signals such that a level of each of the plurality of input signals is within a predetermined range. In an embodiment of the Illuminated Instrument Strap 11 the control box includes a timer providing a time limit adapted to conserve power by turning off the controller when the controller is not in use for a duration longer than the time limit.

Also shown in FIG. 10 is volume controller 48 adapted to control the intensity of input signal reaching the controller such that sensors and illumination signals are not saturated. Thus, when the audio speakers are turned up really high and the controller is operating in an audio sensing mode, the lights are not turned on permanently since the sound signal is saturated due to high level of sound energy being sensed. The volume controller 48 can lower the audio intensity sensed when the observed sound level is high or boost the audio level sensed when they are low. Similarly, the volume controller 48 can adjust the level of input signals received from electrical musical instrument 29 if needed.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

It will thus be seen that the objects set forth above, among those made apparent from the preceding description, are efficiently attained and, because certain changes may be made in carrying out the above method and in the construction(s) set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall there between.

What is claimed is:

1. An instrument strap, comprising:

a first end and a second end wherein each of the first end and the second end has a fastener disposed thereupon with each of the fastener adapted to removably secure the instrument strap to an instrument;

an adjustment mechanism where the adjustment mechanism is disposed between the first end and the second end and separates the instrument strap into a first segment and a second segment wherein the adjustment mechanism is further adapted to change the length of the instrument strap by shortening or elongating a length of the second segment;

a light, including a plurality of LEDs or lights, disposed on first segment of the instrument strap, the light having a connection to a control box wherein the connection between the control box and light is adapted to supply a power to the light;

a power source capable of supplying the power to the light;

the control box attached to the first segment comprising a controller having a non-transitory memory which at least partially stores a logic where the non-transitory memory is in a medium readable by the controller, a plurality of input signals readable by the controller, a plurality of illumination codes readable by the controller adapted to select a previously stored illumination pattern program from non-transitory memory, such that upon reading and executing the logic at least in part by the controller causes the control box to enable the power source to supply power to the light to cause the light to illuminate in a manner determined by the logic, the plurality of input signals, and the illumination pattern program.

2. The instrument strap of claim 1, wherein the control box includes a remote receiver adapted to receive the plurality of illumination codes from a remote control.

3. The instrument strap of claim 1, wherein the control box further includes a power source.

4. The instrument strap of claim 3, wherein the power source is a battery.

5. The instrument strap of claim 3, wherein the power source is a battery capable of being recharged, the control box includes a connector adapted to receive a power source, and connecting the power source to the connector recharges the battery.

6. The instrument strap of claim 1, wherein the plurality of input signals comprise audio signal from a microphone, the microphone adapted to sense audio energy in the environment and generate a corresponding audio signal; and electronic signal generated by an electrical or an electronic device;

where the controller is programmed to use either the audio signal, or the electronic signal, or a combination of both the audio signal and the electronic signal, to create the logic where the logic causes the illumination pattern of the light to be synchronized with the audio signal, the electronic signal, or a combination of both signals, whereby the light illumination patterns represents a visualization of the audio signal, the electronic signal, or a combination of both signals.

7. The instrument strap of claim 6, wherein the electronic signal is generated by an electronic musical instrument selected from a group consisting of guitar, piano, keyboard, wind-instrument and percussion-instrument.

8. The instrument strap of claim 6, further including a three way toggle switch adapted to a selection of one of the illumination pattern program, audio signal, or electronic signal, to read and execute the logic for generating the illumination patterns where the controller is programmed to use the selection of illumination pattern program, the audio signal, or the electronic signal, to create the logic causing the illumination pattern of the light to be synchronized with the selected illumination pattern program, the audio signal, or the electronic signal.

9. The instrument strap of claim 1 wherein the control box further includes a control for level adjustment adapted to attenuate or amplify one or more of the plurality of input signals such that a level of each of the plurality of input signals is within a predetermined range.

10. The instrument strap of claim 1, wherein control box includes a timer providing a time limit adapted to conserve power by turning off the controller when the controller is not in use for a duration longer than the time limit.

11. The instrument strap of claim 1, wherein the first segment having a length and a width dimension further comprising a two-ply composite with an upper-ply having a length and a width dimension and a top and a bottom surface where the upper-ply's length and the width dimension are approximately equal to the first segment's length and width dimension respectively, a lower-ply having a length and a width dimension and a top and a bottom surface where the lower-ply's length and the width dimension are approximately equal to the first segment's length and width dimension respectively, the bottom surface of the upper-ply is attached to the top surface of the lower-ply at pre-determined locations to form the two-ply composite such that the two-ply composite's length and width dimension are approximately equal to the first segment's length and width dimension respectively, wherein the two-ply composite includes a space between bottom surface of the upper-ply and the top surface of the lower-ply;

the light is included in the space between the upper-ply and lower-ply;

the upper-ply includes a hole where the hole is an opening adapted to make one or more of the plurality of lights become visible there-through.

12. The instrument strap of claim 11, wherein the lower-ply and the upper-ply are removably attached to each other using one or more fasteners selected from a group consisting of snap-buttons, Velcro, zippers, and ties.

13. The instrument strap of claim 11, wherein the light comprise Light Emitting Diodes (LEDs) wherein each LED is adapted to generate a set of three primary colors in response to a set of three signals received from the control box.

14. The instrument strap of claim 11, wherein the light included in the space between upper-ply and lower-ply comprises a plurality of lights arranged in a pattern, the upper-ply includes a corresponding pattern of holes, where the corresponding pattern of holes is adapted to substantially enable the plurality of lights to be visible therethrough.

15. The instrument strap of claim 11, wherein the control box is enclosed within the space between the lower-ply and the upper-ply.

16. The instrument strap of claim 11, wherein control box includes a plurality of physical control buttons and the lower-ply includes a cutout adapted to have the physical controls protrude below the lower surface of the lower-ply.

17. The instrument strap of claim 11, wherein the input signal receiver enclosed within the space between the lower-ply and the upper-ply wherein either lower-ply or the upper-ply includes a cut-out for attaching an external input source to the input signal receiver.

18. The instrument strap of claim 11 the plurality of input signals are connected to the control box using a plurality of input electrical conductors, the power source supplies power to a plularilty of lights using a plurality of power electrical conductors, and the plurality of input electrical conductors and the plurliaty of power electrical conductors are enclosed within the space between the lower-ply and the upper-ply.

* * * * *